US006687938B1

(12) United States Patent
Harmon

(10) Patent No.: US 6,687,938 B1
(45) Date of Patent: Feb. 10, 2004

(54) SCREEN DELINTER

(76) Inventor: Jimmy D. Harmon, 1501 Jones Franklin Rd., Raleigh, NC (US) 27606

( * ) Notice: Subject to any disclaimer, the term of this patent is extended or adjusted under 35 U.S.C. 154(b) by 342 days.

(21) Appl. No.: 09/596,647

(22) Filed: Jun. 19, 2000

(51) Int. Cl.[7] ..... A47L 13/40
(52) U.S. Cl. ..... 15/1.52; 15/1.51
(58) Field of Search ..... 15/1.52, 1.51, 15/245, 220.2, 220.3, 236.01, 250.003, 244.4, 257.1, 425, 104.002, 97.2, 424, 221, 220.4, 1, 104.001; D4/137; D32/52, 40; 209/127.1; 206/233, 721, 205, 209, 361, 207, 349; 361/225, 422, 229; 30/169, 329; 224/232

(56) References Cited

U.S. PATENT DOCUMENTS 2,914,787 A * 12/1959 Hartkopf ..... 15/236.01
4,435,798 A * 3/1984 Taub ..... 369/72
4,495,670 A * 1/1985 Baker ..... 15/145
5,155,911 A * 10/1992 Collins ..... 224/232
5,211,322 A * 5/1993 Nealy ..... 224/230
5,560,067 A * 10/1996 Brook ..... 15/104.94
5,704,088 A * 1/1998 Cerroni ..... 15/160
6,182,320 B1 * 2/2001 Kruger et al. ..... 15/1.52

FOREIGN PATENT DOCUMENTS

FR 0587268 * 4/1925

OTHER PUBLICATIONS

English translation of FR 587,268 to Petit, published Apr. 1925.*
http://isd.ingham.k12.mi.us/~goals2k/lessons/scienceless-son/stone2.html, Sandy Stone, May 2000.*
http://www.tricitiesonline.com/kids/kidsneat.htm, 1998, Advanced Internet Marketing Solutions.*
The New York Times, Jun. 20, 1948.*

* cited by examiner

*Primary Examiner*—Robert J. Warden, Sr.
*Assistant Examiner*—Laura C Cole
(74) *Attorney, Agent, or Firm*—Coats & Bennett, P.L.L.C.

(57) ABSTRACT

A screen delinter to delint a computer screen or television screen comprises a planar rectangular plastic body. A handle encloses the body leaving one edge of the body exposed. When not in use, the delinter is stored in a case lined with a wool material. As the delinter is removed from the case, the exposed edge is rubbed against the wool such that a charge is induced on the exposed edge. As the delinter is waved proximate a screen, the lint thereon is attracted to and adheres to the exposed edge.

24 Claims, 3 Drawing Sheets

SCREEN DELINTER

FIELD OF THE INVENTION

The present invention relates to a device for removing lint from a screen such as a computer monitor screen.

BACKGROUND OF THE INVENTION

Televisions were introduced to the public and have steadily increased in popularity until now almost every household in the United States includes at least one, and frequently multiple, television sets. This ubiquitousness has only increased with the introduction of the personal computer. Essentially every personal computer is accompanied by or integrated with a monitor that is not much more than a specialized television.

At the simplest level, both televisions and computer monitors are cathode-ray tubes. A cathode-ray tube is a near vacuum tube, having at one end a negative electrode (a cathode), and a device called an electron gun that emits a beam of electrons against the screen at the opposite end of the tube. A bright spot appears wherever the electrons strike the screen. The electrons are accelerated and focused to strike the screen as a fine point. Between the electron gun and the screen, deflecting plates control the up and down and left to right motion of the beam. In practice, the beam sweeps horizontally across the screen creating images thereon. In most, if not all cathode-ray tubes, the screen is arcuate so that the electrons travel an identical distance from the gun to the screen. One of the side effects of this technology is the creation of a negative charge on the screen. Further, negative charges are created on other types of screens. For example, lap top computers employ LCD screens and negative charges tend to build up on these screens as well.

This charge, coupled with the arcuate face, increases the tendency of dust and lint to collect on the face of the screen. This lint and dust not only obscures the screen causing strain on the eyes of the viewer, but also may contribute to allergies, sinus problems or otherwise create discomfort when the dust is disturbed. It should be noted that this lint and dust has a slight positive charge as a result of its proximity to the negatively charged screen.

In the past, people have used cloth wipes to clean these screens. While this does remove the dust and lint, it may also abrade or mar the surface of the screen as the lint is dragged across the screen. Sometimes people use chemicals that may or may not be suitable for use on the screen. Filmy deposits left behind by these chemicals may damage the surface of the screen or form a residue that obscures the screen.

Thus, there remains a need for a device that removes lint from a screen without the need to touch the screen, thereby avoiding damage to the screen. Additionally, this device should have a housing which cleans the device between uses and prevents emission of the lint to the air.

Other objects and advantages of the present invention will become apparent and obvious from a study of the following description and the accompanying drawings which are merely illustrative of such invention.

SUMMARY OF THE INVENTION

The problems of the prior art are addressed by providing a case lined with wool. The case is preferably slotted on one side such that a generally planar delinter may be inserted therein. The delinter is formed from a planar, piece of plastic having a handle therearound. In a preferred embodiment, the handle is a paper sheath that protects the plastic from human contact on all but one edge. The paper sheath is secured to the plastic by an adhesive that may be used to heat fuse the paper to the plastic.

In use, the delinter is inserted into the case until such time as it is needed to clean the screen of a computer or television. At that time, the delinter is drawn from the case, effectively dragging the plastic edge not covered by the sheath across the wool lining. This creates a negative charge, or at least a charge that is opposite the charge of the dust or lint particles, on the plastic edge. The edge is brought into contact with the screen. The oppositely charged lint on the surface of the screen will be electrostaticly attracted to the delinter and adhere thereto. With a few simple swipes, the lint and dust is effectively removed from the surface of the screen, thereby allowing unhindered use thereof. Reinsertion of the delinter into the case again rubs the exposed edge on the wool, effectively removing accumulated lint from the exposed edge.

DETAILED DESCRIPTION OF THE PREFERRED EMBODIMENTS

The present invention is a device that removes lint from a computer screen or television screen without the need for touching the screen. This ability reduces inadvertent and undesirable scratches on the screen while at the same time cleans the screen to provide for an unobstructed view of the images displayed on the screen.

Figure 1:
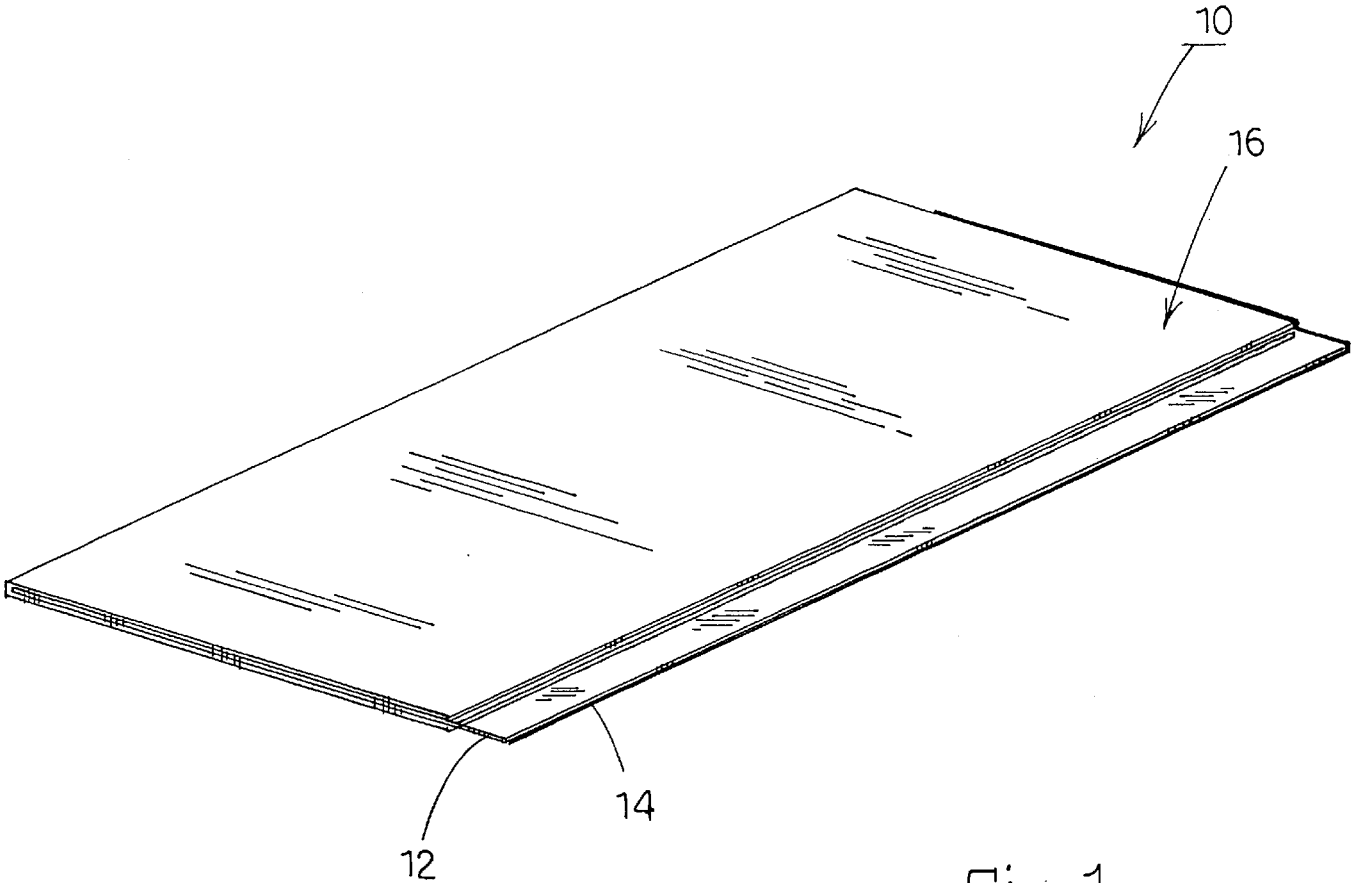
FIG. 1 is a perspective view of the delinter of the present invention.

Turning now to the drawings, and particularly FIG. 1, a delinter 10 is shown in a perspective view. In the preferred embodiment, the delinter 10 comprises a rectangular, planar plastic body 12 with an exposed edge 14. A handle 16 covers the majority of the plastic body 12. Handle 16 may comprise a folded sheet of paper, paper board, or other stiff non-conductive material that is wrapped around the majority of the plastic body 12. Thus, the paper is generally u-shaped, with the plastic body 12 positioned within the channel of the u-shaped paper. Handle 16 may be secured to the plastic body 12 by a conventional adhesive 18 (FIG. 3) by other conventional means.

Figure 2:
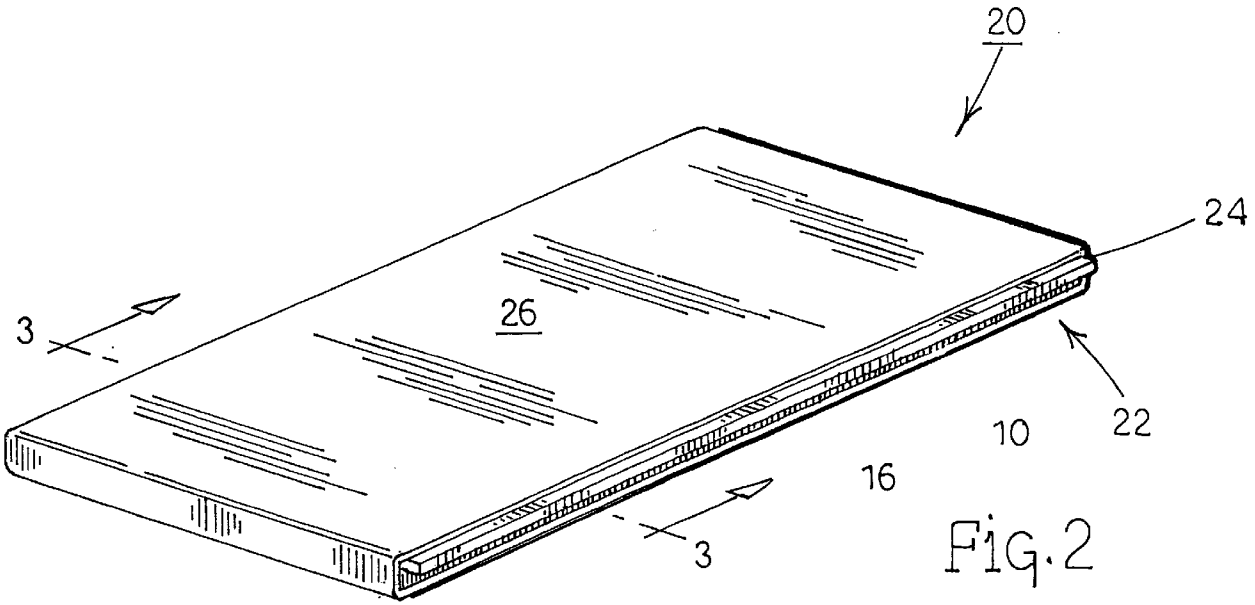
FIG. 2 is a perspective view of the case of the present invention with the delinter inserted therein.
Figure 3:
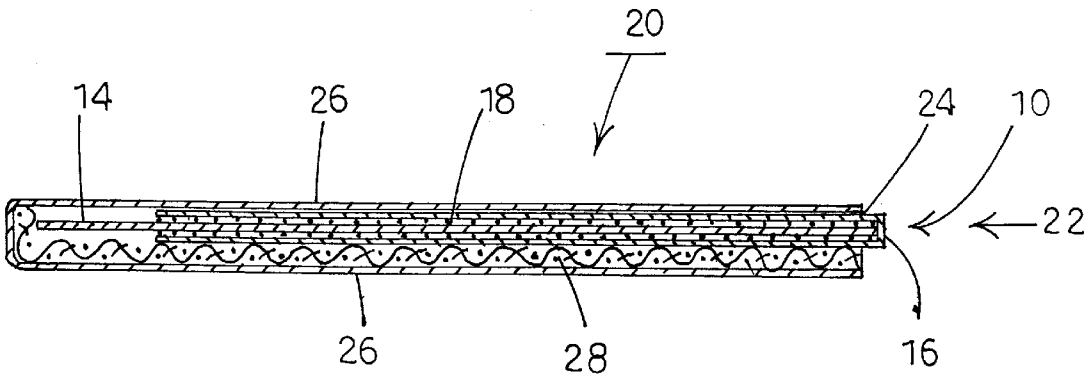
FIG. 3 is a cross sectional view of the case along lines 3—3 of FIG. 2.

Turning now to FIGS. 2 and 3, when not in use, the delinter 10 is preferably positioned in a case 20 that is preferably sized so as to accommodate the delinter 10 therewithin. In the case where the delinter 10 is rectangular and planar, and assumes a similar configuration. Case 20 includes an open edge 22 with slot 24 through which the exposed edge 14 of the plastic body 12 is inserted. Thus, when not in use, the handle 16 is exposed to ambient conditions while the exposed edge 14 is contained within the case 20. As better seen in FIG. 3, the case 20 includes an outer housing 26 and an inner material 28. In the preferred embodiment, the inner material 28 is wool. In the embodiment illustrated, the wool 28 is secured to one side of the housing 26. The inner material 28 may be formed of other materials that induce a negative electrical charge on items dragged thereacross. Inner material 28 can be secured through an appropriate adhesive to outer housing 26.

It should be appreciated that there are many techniques by which the handle 16 may be secured to the plastic body 12. For example, the plastic body 12 may be glued to the handle 16 and secured by applying pressure. Alternatively, an ultrasonic weld, glue, a mechanical closure such as a rivet or the like could be used to secure the handle 16 to the plastic body 12. It is important however, that the handle 16 be non-conductive and electrically isolated from the plastic body 12. While paper is the preferred material from which to form the handle 16, other materials may also be appropriate such as cardboard, construction paper, another plastic, rubber, or the like.

Figure 4:
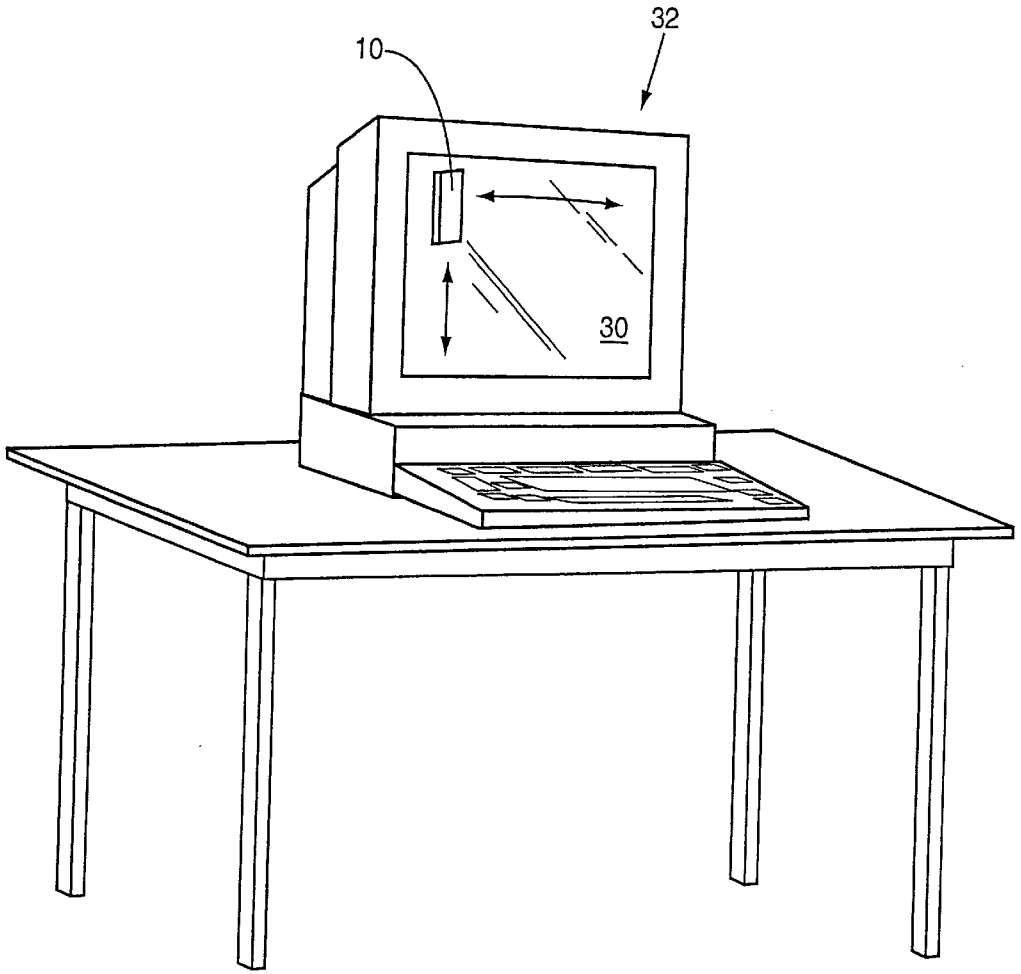
FIG. 4 is a simplified view of the delinter being used to remove lint from a computer screen.

Prior to use, the delinter 10 is inserted into the slot 24 such that the exposed edge 14 is placed into contact with the inner material 28. When it is time to clean a screen, the handle 16 is grasped by the user and the delinter 10 is pulled from the case 20. Exposed edge 14 is drug across the inner material 28 in relatively continuous contact. This creates a negative charge on the exposed edge 14. Then, as seen in FIG. 4, the delinter 10 is brought into contact with a screen 30, such as might be present on a computer monitor 32 or an equivalent television. Delinter 10 is waved in a horizontal fashion, a vertical fashion, a diagonal fashion (not indicated), some combination of these, or some variation of these. Alternatively, the straight edge of exposed edge 14 may be scraped across the screen 30 to pick up lint. This is not preferred as it may scratch the surface of the screen 30. In either case, the delinter 10 is positioned contiguously to the screen 30.

While the plastic body 12 may be of any color, it is preferably transparent so that it may easily be verified that the delinter 10 is in fact delinting the screen 30. Additionally, while the delinter 10 may be of almost any size, the preferred dimensions are approximately 3.5 inches×2 inches (8.9 cm×5.08 cm) with approximately a quarter of an inch exposed to form exposed edge 14. Delinter 10 is preferably essentially planar and has no appreciable thickness, although this dimension too may be modified as needed or desired.

In the embodiment illustrated herein, it has been noted that the inner material 28 within the case 20 is wool. However, it should be appreciated, that there are other materials besides wool that can be used to generate a charge on the plastic. Therefore, other materials besides wool may be used and incorporated into the case 20.

The present invention may, of course, be carried out in other specific ways than those herein set forth without departing from the spirit and essential characteristics of the invention. The present embodiments are, therefore, to be considered in all respects as illustrative and not restrictive, and all changed coming within the meaning and equivalency range of the appended claims are intended to be embraced therein.

What is claimed is:

1. In combination, a case and a delinter, said case comprising:

a. an outer housing and an inner material, said outer housing having an opening such that said delinter may be inserted into the opening and rest against said inner material that in capable of generating a change; and b. said delinter comprising: a planar body and a handle secured to the planar body and leaving one edge of the planar body exposed wherein said exposed edge is adapted to remove lint from a screen.

2. The combination of claim 1 wherein said inner material is wool.

3. The combination of claim 1 wherein said outer housing is formed in part at least from a pliable material.

4. The combination of claim 1 wherein said planar body is formed from a plastic material.

5. The combination of claim 1 wherein said handle is secured to said planar body by an adhesive.

6. The combination of claim 1 wherein said handle extends from said opening when said delinter is inserted into said housing.

7. A device for removing lint from a screen such as a computer screen, comprising:

a plastic sheet;

a non-conductive sheath extending around at least a portion of the plastic sheet, the non-conductive sheath extending around the plastic sheet such that a portion of the plastic sheet projects outwardly from the non-conductive sheath to define an exposed edge of the plastic sheet, wherein the exposed edge of the plastic sheet is capable of being negatively charged for removing lint from the screen, and a case for holding the plastic sheet and non-conductive sheath, wherein the case includes an opening that is bounded in part at least by a charging material that acts to negatively charge the exposed portion of the plastic sheet as the plastic sheet and sheath are moved within the case.

8. The device of claim 7 wherein the charging material is formed by a wool material contained within the case.

9. The device for removing lint from a screen of claim 8 wherein the sheath surrounding a portion of the plastic sheet is formed in part at least from a paper product.

10. A delinter and an outer housing for holding said delinter, said delinter comprising a conductive material; and a nonconductive material enveloping substantially all but one edge of said conductive material, wherein the outer housing generates an electrical charge on the exposed edge of the conductive material for removing lint from a screen.

11. The delinter of claim 10 wherein the conductive material comprises plastic.

12. The delinter of claim 10 wherein the non-conductive material comprises paper.

13. The delinter of claim 10 wherein the non-conductive material is adhered to the conductive material with an adhesive.

14. A device for removing lint from a screen, comprising:

a conductive member for carrying a charge that is effective to remove lint from a screen;

a non-conductive member secured to a portion of the conductive member such that a portion of the conductive member is left exposed;

a charging member for cooperating with the conductive member to place an electrical charge on the conductive member;

the charging member including a housing having an opening therein for receiving the conductive and non-conductive members and further including a charging material that engages and charges the conductive member; and wherein the conductive member is charged by bringing the conductive member into engagement with the charging material, and once charged the conductive member is operative to remove lint from the screen by moving the conductive member adjacent the screen.

15. The lint removing device of claim 14 wherein the housing holds the conductive and non-conductive members.

16. The lint removing device of claim 15 wherein the charging material is disposed interiorly of the housing.

17. The lint removing device of claim 16 wherein the charging material includes opposed surfaces that define an area therebetween for receiving the conductive and non-conductive members.

18. The lint removing device of claim 17 wherein the housing includes an opening that permits the conductive and non-conductive members to be inserted there through and between the opposed surfaces of the charging material.

19. The lint removing device of claim 18 wherein the housing includes a top, bottom and a series of side edges, wherein the opening formed in the housing comprises an open side edge that is generally aligned with the opposed surfaces of the charging material such that the conductive and non-conductive members can be inserted through the open side edge of the housing and between the opposed surfaces of the charging material.

20. The lint removing device of claim 18 wherein the conductive member includes a generally flat piece of plastic, and wherein the nonconductive member is pliable and wraps around a portion of the plastic.

21. The lint removing device of claim 20 wherein the charging material includes wool.

22. The lint removing device of claim 14 wherein the charging material is disposed interiorly of the housing such that the charging material engages the conductive member as the conductive member is inserted into the housing and as the conductive member is removed from the housing.

23. The lint removing device of claim 14 wherein the lint to be removed includes a charge, and wherein the charging material is selected so as to charge the conductive member with a charge that is opposite from the charge of the lint.

24. The lint removing device of claim 23 wherein the charging material places a negative charge on the conductive member.

* * * * *